US009187291B2

(12) United States Patent
Alexandre

(10) Patent No.: US 9,187,291 B2
(45) Date of Patent: Nov. 17, 2015

(54) CORD ORGANIZER FOR PORTABLE ELECTRONIC DEVICES

(71) Applicant: Clark J. Alexandre, Piermont, NY (US)

(72) Inventor: Clark J. Alexandre, Piermont, NY (US)

( * ) Notice: Subject to any disclaimer, the term of this patent is extended or adjusted under 35 U.S.C. 154(b) by 180 days.

(21) Appl. No.: 13/891,836

(22) Filed: May 10, 2013

(65) Prior Publication Data

US 2013/0313352 A1 Nov. 28, 2013

Related U.S. Application Data

(60) Provisional application No. 61/648,656, filed on May 18, 2012.

(51) Int. Cl.

| | |
|---|---|
| ***B65H 75/34*** | (2006.01) |
| ***B65H 75/14*** | (2006.01) |
| ***B65H 75/28*** | (2006.01) |
| ***B65H 75/40*** | (2006.01) |
| ***B65H 75/44*** | (2006.01) |

(52) U.S. Cl.

CPC ..... *B65H 75/34* (2013.01); *B65H 75/146* (2013.01); *B65H 75/28* (2013.01); *B65H 75/406* (2013.01); *B65H 75/4471* (2013.01); *B65H 2701/34* (2013.01)

(58) Field of Classification Search

CPC ..... B65H 75/14; B65H 75/28; B65H 75/406; B65H 2701/34; B65H 2701/3919

USPC ..... 242/388.1–388.2, 388.6, 405.1, 588.3, 242/118.4, 579, 580, 587, 587.2

See application file for complete search history.

(56) References Cited

U.S. PATENT DOCUMENTS

| | | | | |
|---|---|---|---|---|
| 151,947 | A | 6/1874 | Witsil et al. | |
| 2,565,339 | A | 7/1946 | Anderson | |
| 2,952,420 | A * | 9/1960 | Von Hoorn | 242/388.1 |
| 3,809,331 | A | 5/1974 | Gaul | |
| 4,068,808 | A | 1/1978 | King | |
| 4,390,142 | A * | 6/1983 | Cheng | 242/388.1 |
| 4,417,703 | A | 11/1983 | Weinhold | |
| 4,442,984 | A | 4/1984 | Bayat | |
| 4,901,938 | A | 2/1990 | Cantley et al. | |
| 5,449,067 | A | 9/1995 | Cannon | |
| 5,613,648 | A | 3/1997 | Paavila | |
| 5,772,152 | A | 6/1998 | Maldonado | |
| 6,065,708 | A | 5/2000 | Matsubara | |
| 6,186,433 | B1 | 2/2001 | Kovacik et al. | |
| 6,554,218 | B2 | 4/2003 | Buyce et al. | |
| 7,188,814 | B2 | 3/2007 | Davis | |
| 7,399,199 | B2 | 7/2008 | Symons | |
| 7,446,260 | B2 | 11/2008 | Hammonds | |
| 7,984,798 | B1 | 7/2011 | Hall | |
| 2005/0092861 | A1 | 5/2005 | Marsden | |
| 2005/0242223 | A1 | 11/2005 | Woodward | |
| 2007/0108333 | A1* | 5/2007 | Kuramoto | 242/395 |
| 2007/0108334 | A1* | 5/2007 | Kuramoto | 242/407 |
| 2011/0036676 | A1* | 2/2011 | Skillman | 191/12.4 |
| 2012/0056030 | A1 | 3/2012 | Shogren | |
| 2013/0306781 | A1* | 11/2013 | Tong | 242/388.1 |

* cited by examiner

*Primary Examiner* — Sang Kim

(74) *Attorney, Agent, or Firm* — Onofrio Law; Dara L. Onofrio, Esq.

(57) ABSTRACT

A device, and related method, for storing and organizing a power supply cord for portable electronic devices, wherein the device includes an outer shell 1 having a first entry hole 4; and an inner spool 2 having at least two circular flanges 6 connected in the middle by a barrel 8; a track 10 between the flanges; an arbor 7 on the top side and bottom side of the barrel; a second entry hole 5 within the device; and at least one tread 3 on the inner portion of the outer shell, wherein the spool fits snuggly into the outer shell to allow the spool to rotate therein.

20 Claims, 9 Drawing Sheets

CORD ORGANIZER FOR PORTABLE ELECTRONIC DEVICES

This application claims the benefit of U.S. provisional application No. 61/648,656 filed May 18, 2012, which is incorporated herein in its entirety by reference.

FIELD OF THE INVENTION

The present invention relates to a cord organizer. In particular the invention relates to device that stores and organizes power supply cords for portable electronic devices.

BACKGROUND OF THE INVENTION

The National Electric Code (NEC) provides a classification system for power supplies. The following are relevant to the present invention.

Class 2. A Class 2 circuit is the portion of the wiring system between the load side of a Class 2 power source and the connected equipment.

Class II (with Roman numerals). A Class II circuit refers to power supplies with either a double or reinforced insulation barrier between the input and the output.

Due to its power limitations, a Class 2 or Class II circuit considers safety from a fire initiation standpoint and provides acceptable protection from electric shock. Most cell phone and mobile device chargers and laptop power supplies are Class II.

Class 1. A Class 1 circuit is connected to a power limited source but offers no protection from fire or electric shock. A Class 2 circuit offers the highest degree of protection.

Users of portable electronic typically struggle with cord management of the power supply cord. The cords are generally over 2 feet long and typically get tangled up with other cords or worse get snagged causing the device being charged to fall to the floor. The invention provides a solution to this common problem by providing a device that securely holds Class 2 and Class II, power supply cords for portable electronic devices such as mobile phones, mp3 players, hand held games, e-readers, tablets and other similar devices.

The prior art has described various cord holding devices. Representative of the prior art are the following patents.

U.S. Pat. No. 5,772,152 to Maldonado discloses a cord holder having an outer rotatable housing with an inner spool that rotates within a stationary hollow cord storage spool support. The spool fits into the housing in a telescopic manner.

U.S. Pat. No. 6,065,708 to Matsubara discloses a cord winder that includes a bottomed cylindrical shape and rotatable second component held in place therein. The rotatable component includes ribs formed on an outer surface of the cylindrical stud in a bobbin like structure. The device also includes a curved toothed braking structure.

U.S. Pat. No. 6,186,433 B1 to Kovacik et al. discloses a manually wound cord storage apparatus having a central hub, a handle and at least two feet attached to a planar body. The spool for storing an electrical cord is rotatably mounted on the central hub. A winding knob is mounted on the spool to assist in rotation of the spool around the central hub. The feet permit the apparatus to be used and stored in an upright position.

U.S. Pat. No. 6,554,218 B2 to Buyce et al. discloses a cable management spool for storing a length of cable including a spool and rigid members.

While spools are used in theses references, the prior art does not teach or suggest the invention device which includes two main parts, an outer shell and a rotatable spool that snaps snuggly into the inner part of the shell. The rotatable spool has one or two tracks which assist in securing the spool to the shell but also permits the spool to freely spin inside the shell. The tracks are located at either the inner top or bottom of the shell. The shell has a first entry hole big enough so that the power supply cord can fit thru.

To use the invention device, the portable power supply cord is lopped into the first entry hold of the outer shell leaving both ends of the cord free. The rotatable spool includes two or three flange of equal size. The spool has a centrally located second entry hole. The power supply cord after being looped into the shell is then looped into the second entry hole of the spool, still leaving both ends of the cord free. No hook or locking mechanism is necessary to hold the cord in place. Once the cord is looped onto the spool it is then snapped into the track of the shell. The rotatable spool is then manually wound to retract the cord into the invention device. When the cord is wound the power supply end of the cord is then inserted into the arbor of the spool. To retrieve the cord, all the user has to do is detach the power supply end from the arbor hole of the spool and pull out both ends of the cord to the desired length.

An advantage of the invention is in the provision of a solution to neatly and compactly store power cords for portable electronic devices.

Another advantage of the invention is in the provision of a solution to neatly and compactly store the power supply end for portable electronic devices.

Another object of the invention is to provide a compact device to improve ease of storage and use of power supply cords for portable electronic devices.

Yet another object of the invention is to provide convenient storage of power supply cords while allowing variable lengths to be deployed as desired.

Another object of the invention is in the provision of a compact device and related manual method to store and use power supply cords without the use of springs or any other mechanical elements, other than the rotatable spool.

Still another object of the invention is in the provision of a device that is not spring loaded, thus it does not have any mechanism that will break down.

Another object of the invention is in that the device can be used with the existing power supply that comes with electronic device.

SUMMARY OF THE INVENTION

In the present invention, these purposes, as well as others which will be apparent, are achieved generally by providing a device that stores and organizes a power supply cord for portable electronic devices.

The device comprises an outer shell 1 having a first entry hole 4; and an inner spool 2 having at least two circular flanges 6 connected in the middle by a barrel 8; a track 10 between the flanges; an arbor 7 on the top side and bottom side of the barrel; a second entry hole 5 within the device; and at least one tread 3 on the inner portion of said outer shell, wherein the spool fits snuggly into the outer shell to allow the spool to rotate therein.

At least one side of the arbor includes openings for the plug of the power supply cord to rest. In alternate embodiments, both sides of the arbor includes openings for the plug of the power supply cord to rest.

In the embodiment where there are two circular flanges the second entry hole 5 is on said barrel itself.

The components are made from materials selected from the group consisting of plastic, rubber, wood and metal.

The circular flanges in the invention preferably have a diameter in the range of 1.5 to 5.0 inches and a thickness in the range of 0.03 to 0.20 inches.

The barrel preferably has a width in the range of 0.30 to 0.80 inches.

The outer shell has a diameter slightly larger than the circular flange. Preferably the diameter of the outer shell is between 0.04 to 0.08 inches larger than the circular flange.

In a preferred embodiment the inner spool has three circular flanges, a right flange, a left flange and a center flange. In this embodiment the second entry hole 5 is a notch on the center flange. Both embodiments function in a similar manner. However, the three flange embodiment creates two tracks 10 wherein the power cord is stored in these two tracks as opposed to the one track in the two flange embodiment.

The track 10 width between the two flanges is in the range of 0.2 to 0.6 inches. In the three flange embodiment the track 10 width between the right, left and middle flanges is in the range of 0.15 to 0.25 inches.

The device may also include additional treads 3 to further secure the outer shell together with the inner spool.

The invention also includes a method for storing and organizing a power supply cord for portable electronic devices. The method includes the steps of providing a device that has an outer shell 1 having a first entry hole 4; and an inner spool 2 having at least two circular flanges 6 connected in the middle by a barrel 8; a track 10 between the flanges; an arbor 7 on the top side and bottom side of the barrel; a second entry hole 5 within the device; and at least one tread 3 on the inner portion of the outer shell, wherein the spool fits snuggly into the outer shell to allow the spool to rotate therein.

To wrap up and store the power cord the user aligns the first entry hole 4 with the second entry hole 5. The power cord is looped in half and then the loop is inserted into both holes.

While holding the outer shell in place; the user manually winds the inner spool to retract the power supply cord into the track 10 of the device and to desired length.

In embodiments where the device further includes an arbor with openings for a plug; the user can take the further step of plugging the power supply cord plug into the openings for easy storing.

To unwind the power cord, the user again holds the outer shell in place and pulls the cord together to unwind to desired length or to remove completely.

In embodiments where the inner spool has three circular flanges, a right flange, a left flange and a center flange, two tracks 10 are created. The second entry hole 5 is on the center flange. In this embodiment the further step of winding the inner spool to retract each loop of the power supply cord separately into each of the two tracks occurs.

Other objects, features and advantages of the present invention will be apparent when the detailed description of the preferred embodiments of the invention are considered with reference to the drawings, which should be construed in an illustrative and not limiting sense.

BRIEF DESCRIPTION OF THE DRAWINGS

FIG. 1 is an illustration of a side profile of the components of the invention device in the embodiment with three flanges.

FIG. 2 is an illustration of a the front profile of the components of the invention device in the embodiment with three flanges.

FIG. 3 is an illustration of a the front profile of the components of the invention device in the embodiment with two flanges.

FIG. 4 is an illustration of a side profile of the components of the invention device in the embodiment with two flanges.

FIG. 7 are illustrations with a mobile phone power supply cord, FIG. 8 are illustrations with an e-reader power supply cord.

DETAILED DESCRIPTION OF THE INVENTION

In accordance with the present invention a device that stores and organizes a power supply cord for portable electronic devices is provided.

Figure 1A:
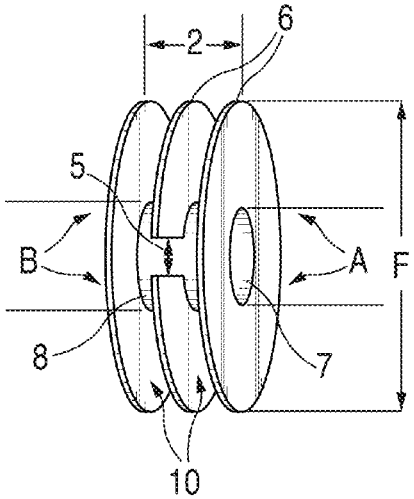
FIG. 1A is the spool.
Figure 1B:
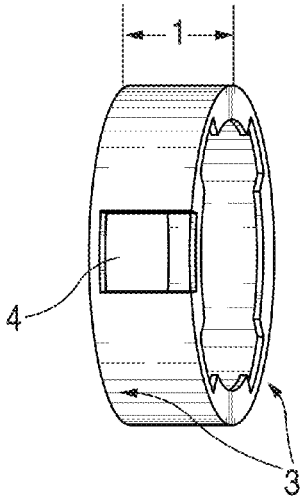
FIG. 1B is the shell and FIG. 1C is the spool and shell combined.
Figure 1C:
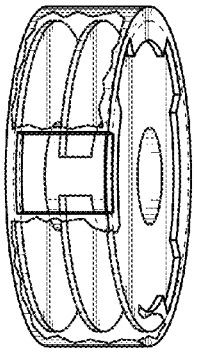

As described in the accompanying drawings the structures of the invention device are labeled as follows:

1—Outer shell
2—Spool
3—Tread
4—First entry hole
5—Second entry hole
6—Flange
7—Arbor
8—Barrel
9—Power Cord
10—Track In general, FIG. 1 is an illustration of a side profile of the components of the invention device in the embodiment with three flanges. FIG. 1A illustrates a side profile of the spool 10, FIG. 1B is a side profile of the shell 1 and FIG. 1C is the spool 2 and shell 1 combined. The spool fits snuggly into the outer shell such that the spool stays in place but can still rotate therein.

The outer shell 1 has a first entry hole 4 and an inner spool 2 having three circular flanges 6. The flanges are all of equal size and are also referred to herein as right, left and center.

The flanges are connected in the middle by a barrel 8. Two separate tracks 10 are between the flanges and are used to store the power cord. There is an arbor 7 at the top and bottom of the barrel and a second entry hole 5 which is a notch in the center flange. There is at least one tread 3 on the inner portion of the outer shell. This enables the spool to fit snuggly into the shell and allows the spool to rotate therein.

The top and bottom arbor 7 includes openings for the plug to rest, and can be on one or both sides.

The components of the invention are preferably made of plastic, any type of consumer plastic, rubber, wood, or metal, although the device is not limited to these materials and other materials can be used.

The circular flange has a diameter in the range of approximately 1.5 to 5.0 inches, with a preferred diameter of approximately 2.0 inches. The preferred thickness of the flanges, are in the range of 0.03 to 0.20 inches or most preferably between 0.06 to 0.1 inches.

The barrel of the device has a width in the range of 0.30 to 0.80 inches, most preferably between 0.50 to 060 inches. The barrel interior can be hollow or solid, depending on the embodiment.

The outer shell has a diameter slightly larger than the circular flanges to insure a snug fit. The outer shell diameter is preferably between 0.04 and 0.08 inches larger than the circular flange, most preferably 0.06 inches larger.

In the two flange embodiment, the track 10 width between the two flanges is preferably in the range of 0.20 to 0.60 inches.

In the three flange embodiment, the track 10 width between the three flanges is in the range of 0.15 to 0.25.

The outer shell can include additional treads 3 on the interior edge surfaces, such that the outer shell screws into the inner spool to help keep the inner spool in place while permitting it to still rotate.

Figure 2A:
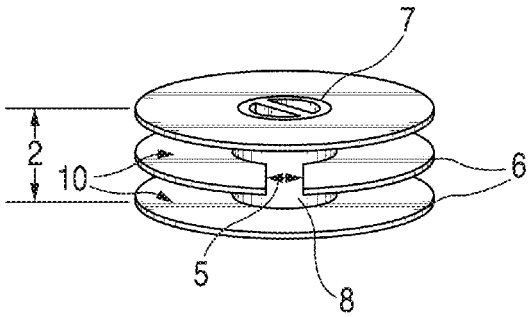
FIG. 2A is the spool.

FIG. 2 is an illustration of the front profile of the components of the invention device in the embodiment with three flanges. FIG. 2A illustrates a front profile of the spool 2. The second entry hole 5 which is a notch in the center flange is prominently displayed. The two separate tracks 10 are illustrated and are of equal width.

Figure 2B:
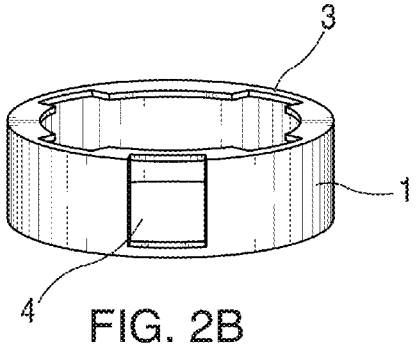
FIG. 2B is the shell and FIG. 2C is the spool and shell combined with the power cord.

FIG. 2B illustrates the outer shell 1 and the inner tread 3, as well as the first opening hole 4.

Figure 2C:
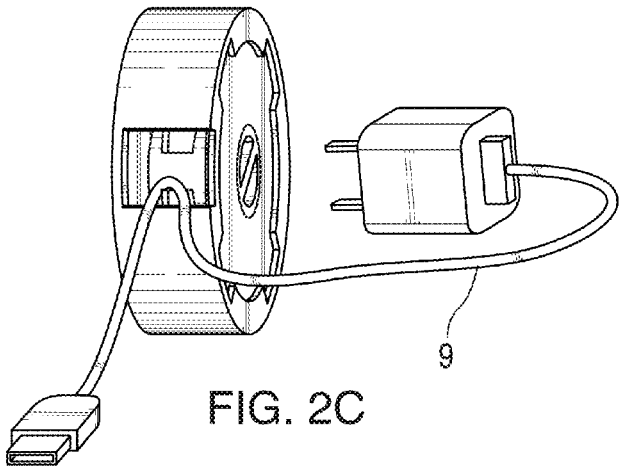

FIG. 2C illustrates the spool 2 and shell 1 combined with the power cord inserted into the first and second entry holes. The power cord has not yet been wound up into the device.

Figure 3A:
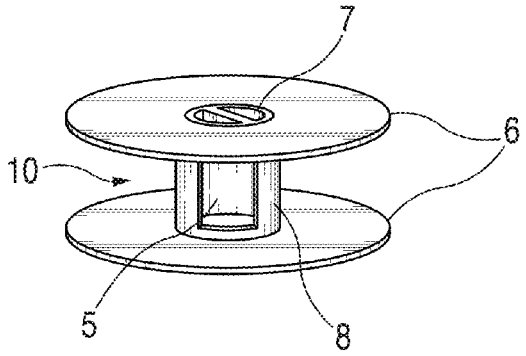
FIG. 3A is the spool.

FIG. 3 is front profile of the components of the invention device in the embodiment with two flanges. FIG. 3A shows a frontal view of the spool 1, wherein the second entry hole 5 is seen right on the barrel 8. The two flanges 6 are of equal size and create one track 10 to wind and store the power cord. The arbor 7 is shown with openings to place the plug of the power supply cord.

Figure 3B:
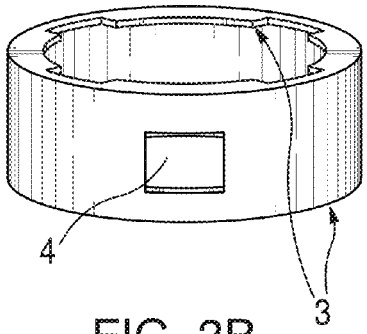
FIG. 3B is the shell and FIG. 3C is the spool and shell combined.

FIG. 3B shows a frontal view of the shell 1, with the first entry hole 4 and tread 3 on both the top and bottom of the inner most portion of the shell. These treads help keep the shell and spool together, while still permitting the spool to rotate.

Figure 3C:
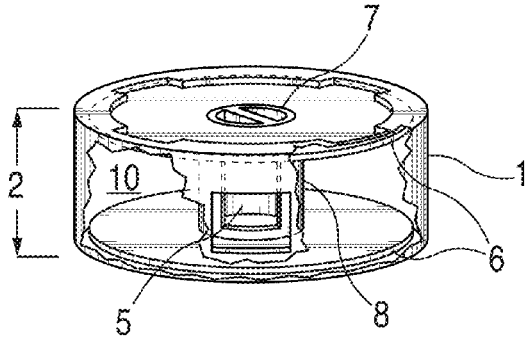

FIG. 3C is a frontal view of the spool 2 and shell 1 combined. The second entry hole 5 is seen on the barrel 8 itself. The flanges 6 are of equal size and the arbor 7 includes an opening for the plug of the power supply cord. Only one track 10 is formed for housing the power supply cord.

As previously mentioned the three flanges is the preferred embodiment. The three flanges—right, left and center—provide a dual track for the cord storage. In the two flange embodiment only a single track for the cord is provided. The second entry hole 5 is an opening on the barrel itself. In this two flange embodiment the interior of the barrel is preferably hollow.

FIG. 4 is an illustration of a side profile of the components of the invention device in the embodiment with two flanges.

Figure 4A:
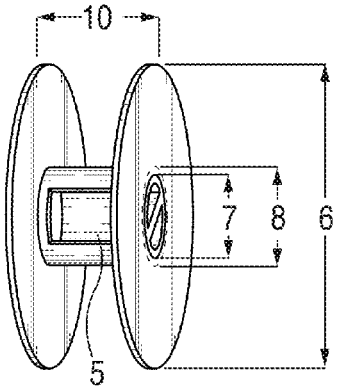
FIG. 4A is the spool.

FIG. 4A illustrates the spool 2, and shows the second entry hole 5 on the barrel 8. The circular flanges 6 are of equal size. The arbor 7 includes openings for the plug of the power supply cord.

Figure 4B:
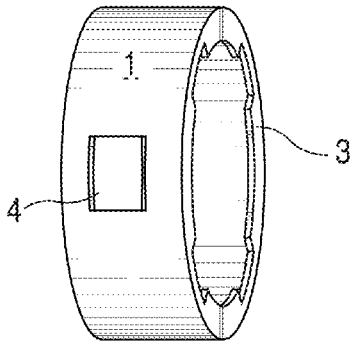
FIG. 4B is the shell and FIG. 4C is the spool and shell combined with the power cord.
Figure 4C:
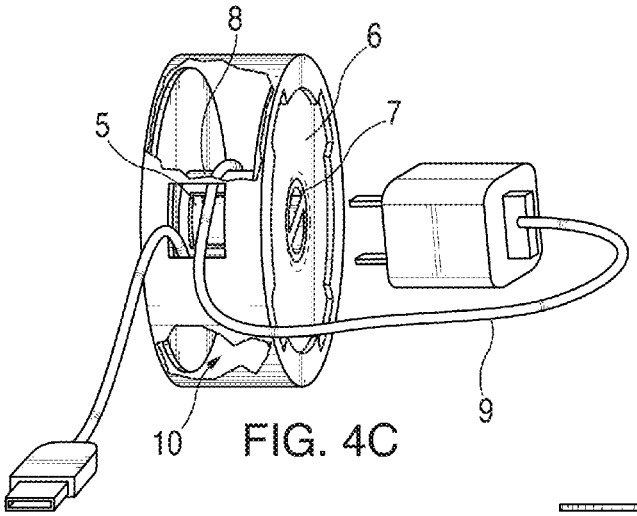

FIG. 4B illustrates the shell 1 and shows the first entry hole 3. The tread 3 is also visible on the inner portion of the shell. FIG. 4C shows the combination of the spool 2 and shell 1 combined with the power cord 9.

Figure 5:
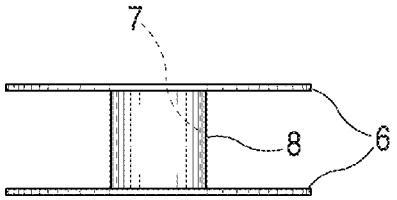
FIG. 5 is an illustration of the shell component indicating the arbor 7 and barrel 8 elements.

FIG. 5 is an illustration of the shell component illustrating the arbor 7 and barrel 8 elements.

The invention also provides a method for storing and organizing a power supply cord for portable electronic devices. The method includes the steps of providing a device that has an outer shell 1 having a first entry hole 4; and an inner spool 2 having at least two circular flanges 6 connected in the middle by a barrel 8; a track 10 between the flanges; an arbor 7 on the top side and bottom side of the barrel; a second entry hole 5 within the device; and at least one tread 3 on the inner portion of the outer shell, wherein the spool fits snuggly into the outer shell to allow the spool to rotate therein.

FIGS. 6 A, B, C and D, illustrate the steps involved in using the invention device to store a power supply cord.

Figure 6A:
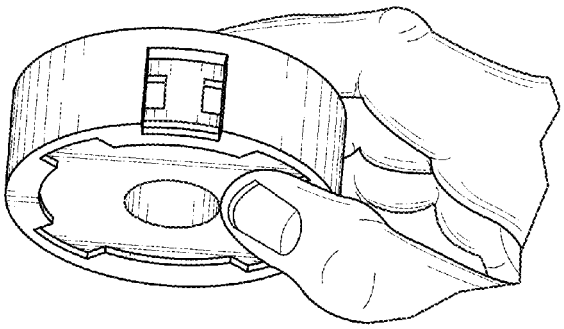
FIGS. 6 A, B, C and D, illustrate the steps involved in using the invention device to store a power supply cord.
Figure 6B:
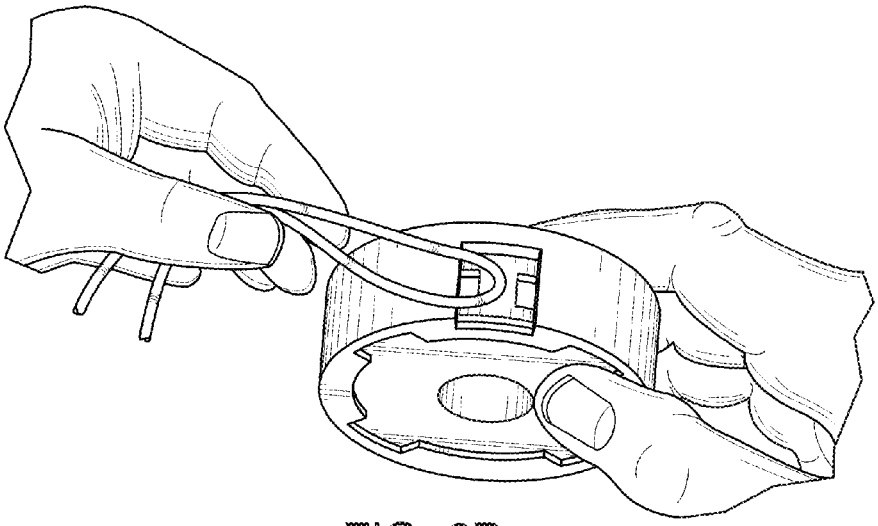

In FIG. 6A, the openings are aligned to expose the track. Specifically, to wrap up and store the power cord the user aligns the first entry hole 4 with the second entry hole 5. In FIG. 6B, the power cord is looped in half and then the loop is inserted into both holes of the invention device.

Figure 6C:
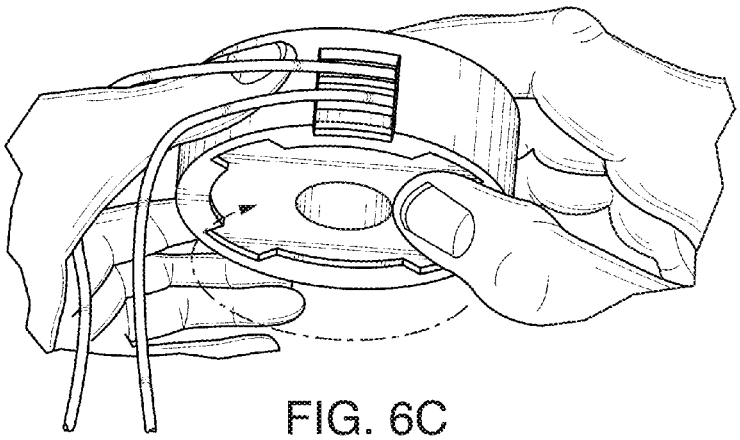

In FIG. 6C, while holding the outer shell in place, the user manually winds the inner spool to retract the power supply cord into the track of the device and to a desired length.

In embodiments where the device further includes an arbor with openings for a plug; the user can take the further step of plugging the power supply cord plug into the openings for easy storing.

Figure 6D:
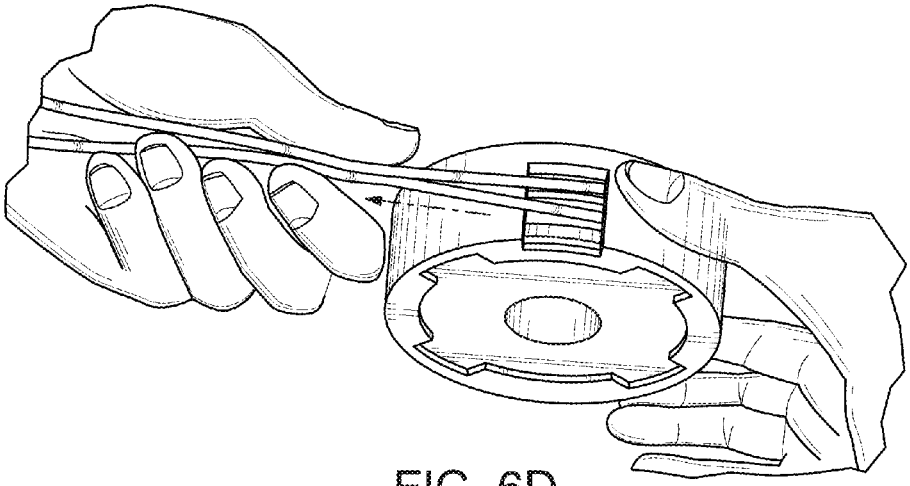

FIG. 6D illustrates how to unwind the power cord from the invention device. To unwind the power cord, the user again holds the outer shell in place and pulls the cord together to unwind to desired length or to remove completely.

In embodiments where the inner spool has three circular flanges, a right flange, a left flange and a center flange, two tracks 10 are created. The second entry hole 5 is on the center flange. In this embodiment the further step of winding the inner spool to retract each loop of the power supply cord separately into each of the two tracks occurs.

Figure 7A:
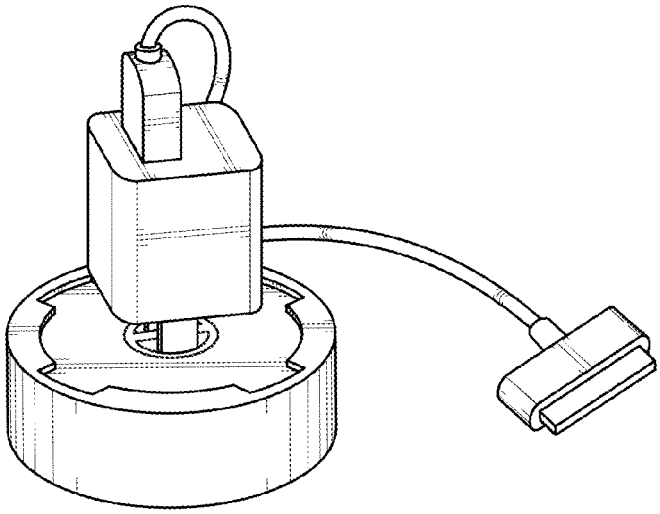
FIG. 7A illustrates the device when cord is stored.
Figure 7B:
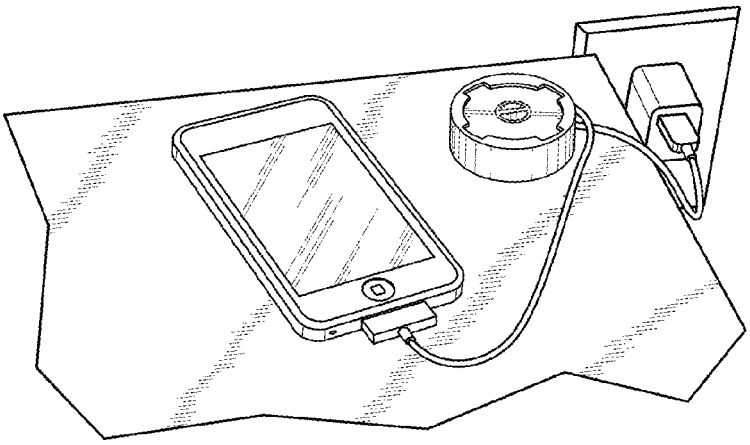
FIG. 7B illustrates the device in use.
Figure 7C:
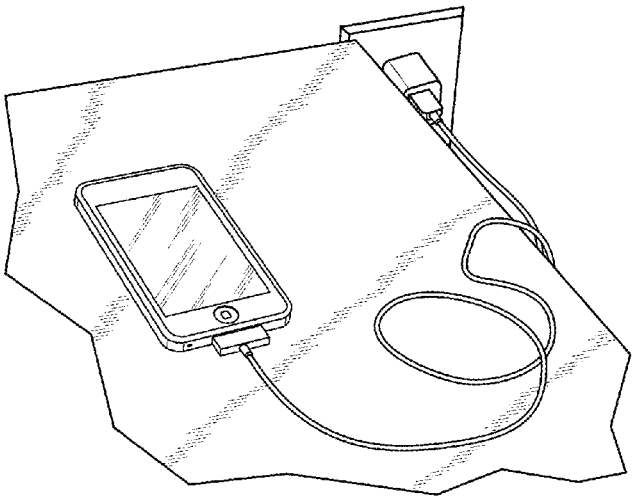
FIG. 7C illustrates the prior art without the use of the device.

FIG. 7 are illustrations with a mobile phone power supply cord. FIG. 7A illustrates the device when stored and shows the power cord plug plugged into the arbor of the invention. FIG. 7B illustrates the device in use and FIG. 7C illustrates the prior art usage without the device. The advantage of the invention is clearly seen from the comparison between FIGS. 7A and 7B and the prior art in FIG. 7B. The clumsy manner in which the power cord is connected to the mobile device is an accident waiting to happen.

Figure 8A:
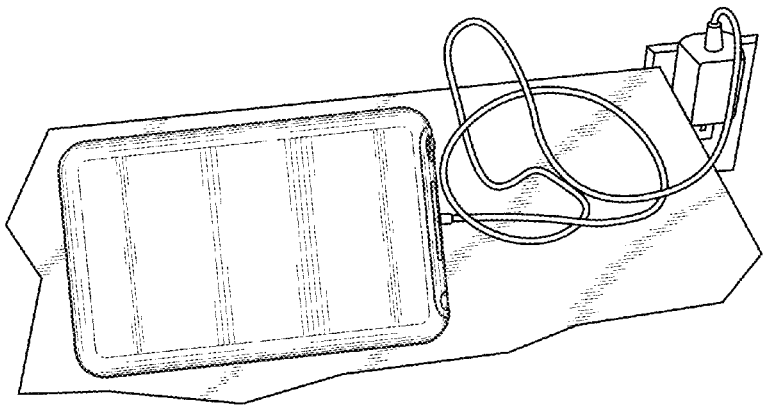
FIG. 8A illustrates the prior art without the use of the device.
Figure 8B:
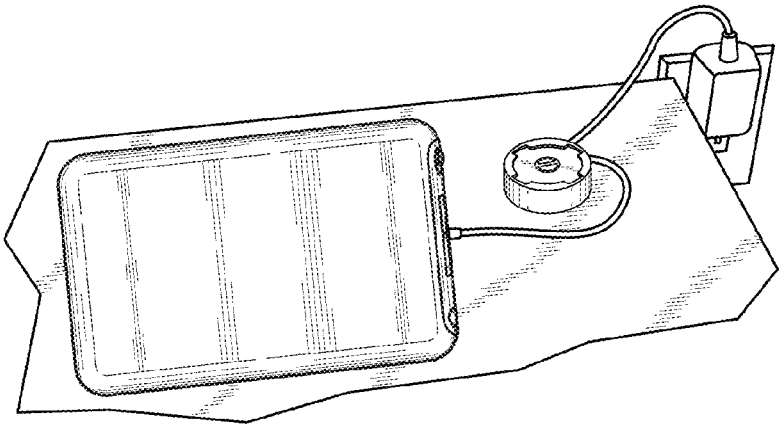
FIG. 8B illustrates the device in use.
Figure 8C:
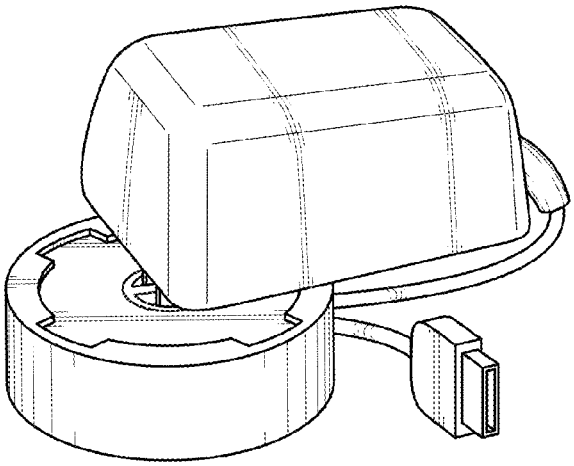
FIG. 8C illustrates the device when stored.

FIG. 8 are illustrations with an e-reader power supply cord. FIG. 8A illustrates the prior art usage without the device; FIG. 8B illustrates the device in use and FIG. 8C illustrates the device when stored. The advantage of the invention is clearly seen from the comparison between FIGS. 8B and 8C and the prior art in FIG. 8A. The power supply cord in FIG. 8A is curled and tangled, whereas in FIG. 8B the power supply to the e-reader is neatly stored within the invention device while it is being charged. FIG. 8C illustrates the neat compact storage of the power supply cord once it has been unplugged from the e-reader. The invention device helps prevent damage to the power supply cord by keeping it from getting snagged or broken.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A device that stores and organizes a power supply cord for portable electronic devices comprising two detachable components:

the first component is an outer shell (1) having a first entry hole (4), and with at least one tread (3) on an inner portion of said shell; and the second component is an inner spool (2) having at least two circular flanges (6) connected in the middle by a barrel (8), wherein said barrel has a top side and a bottom side; said inner spool includes a track (10) between said flanges;

and an arbor (7) on the top side and bottom side of said barrel;

a second entry hole (5) within said second component of the device wherein said second component fits snugly within said first component tread (3) to allow said inner spool to rotate therein.

2. The device according to claim 1, wherein at least one side of said arbor includes openings for a plug of the power supply cord to rest.

3. The device according to claim 1, wherein said second entry hole (5) is in the middle of said barrel between said top side and said bottom side.

4. The device according to claim 1, wherein said components are materials selected from the group consisting of plastic, rubber, wood and metal.

5. The device according to claim 1, wherein said circular flange has a diameter in the range of 1.5 to 5.0 inches.

6. The device according to claim 1, wherein said circular flange has a thickness in the range of 0.03 to 0.20 inches.

7. The device according to claim 1, wherein said barrel has a width in the range of 0.30 to 0.80 inches.

8. The device according to claim 1, wherein said outer shell has a diameter slightly larger than said circular flange.

9. The device according to claim 8, wherein the diameter of said outer shell is between 0.04 to 0.08 inches larger than said circular flange.

10. The device according to claim 1, wherein said inner spool has three circular flanges, a right flange, a left flange and a center flange.

11. The device according to claim 10, wherein said second entry hole (5) is a notch on said middle flange.

12. The device according to claim 1, wherein the track (10) width between the two flanges is in the range of 0.2 to 0.6 inches.

13. The device according to claim 10, wherein the track (10) width between the right, left and center flanges is in the range of 0.15 to 0.25 inches.

14. The device according to claim 1, further comprising an additional treads (3).

15. A method for storing and organizing a power supply cord for portable electronic devices comprising the steps of:

providing a device comprised of two detachable components, the first component is an that has an outer shell (1) having a first entry hole (4); and the second component is an inner spool (2) having at least two circular flanges (6) connected in the middle by a barrel (8), wherein said barrel has a top side and a bottom side; said inner spool includes a track (10) between said flanges; and an arbor (7) on the top side and bottom side of said barrel; a second entry hole (5) within said second component of the device; wherein said second component fits snuggly into said first component to allow said inner spool to rotate therein;

aligning said first entry hole 4 of said first component with said second entry hole (5) of said second component;

looping the power cord and inserting the loop into both said holes;

holding said outer shell in place; and winding said inner spool to retract said power supply cord into the track (10) of the device and to desired length.

16. The method according to claim 15, wherein said arbor has openings for a plug of the power supply cord and comprising the further step of plugging the power supply cord plug into said openings.

17. The method according to claim 15, comprising the further step of unwinding the power cord by holding said outer shell in place and pulling the cord together to unwind to desired length or to remove completely.

18. The method according to claim 15, wherein said inner spool has three circular flanges, a right flange, a left flange and a center flange which creates two tracks (10) and wherein the second entry hole (5) is on the center flange; comprising the further step of winding said inner spool to retract such that each loop of said power supply cord retracts separately into each of the two tracks.

19. The method according to claim 15, wherein said second entry hole (5) is in the middle of said barrel between said top side and said bottom side.

20. The method according to claim 15, wherein said second component is easily snapped into said first component and is easily detached.

* * * * *